US007414010B2

(12) United States Patent
Burrows

(10) Patent No.: US 7,414,010 B2
(45) Date of Patent: Aug. 19, 2008

(54) SOFT FABRIC BOOK WITH HIGH RESOLUTION IMAGES AND METHOD OF MAKING SAME

(75) Inventor: Roger Burrows, Wilton, CT (US)

(73) Assignee: Sandvik Innovations, LLC, Wayne, PA (US)

( * ) Notice: Subject to any disclaimer, the term of this patent is extended or adjusted under 35 U.S.C. 154(b) by 285 days.

(21) Appl. No.: 11/157,575

(22) Filed: Jun. 21, 2005

(65) Prior Publication Data

US 2006/0046935 A1 Mar. 2, 2006

Related U.S. Application Data

(60) Provisional application No. 60/583,092, filed on Jun. 25, 2004.

(51) Int. Cl.
*B41M 5/035* (2006.01)
*B41M 5/385* (2006.01)

(52) U.S. Cl. ..... 503/227; 8/471

(58) Field of Classification Search ..... None
See application file for complete search history.

(56) References Cited

U.S. PATENT DOCUMENTS

| | | | | |
|---|---|---|---|---|
| 3,363,557 | A | 1/1968 | Blake | 101/470 |
| 3,829,286 | A | 8/1974 | Anzai et al. | 8/2.5 |
| 4,210,412 | A | 7/1980 | Yamane et al. | 8/471 |
| 4,265,630 | A | 5/1981 | Bäuerle | 8/456 |
| 4,354,851 | A | 10/1982 | Hix et al. | 8/471 |
| 4,492,584 | A | 1/1985 | Jenkins | 8/471 |
| 4,795,675 | A | 1/1989 | Dunn, Jr. et al. | 428/260 |
| 5,270,284 | A | 12/1993 | Kanto et al. | 503/227 |
| 5,961,150 | A | 10/1999 | Kogutt et al. | 281/37 |
| 6,045,965 | A | 4/2000 | Cournoyer et al. | 430/263 |
| 6,174,039 | B1 | 1/2001 | Miyake et al. | 347/12 |

(Continued)

*Primary Examiner*—Bruce H Hess
(74) *Attorney, Agent, or Firm*—Drinker Biddle & Reath LLP

(57) ABSTRACT

The invention encompasses a fabric book with high resolution sublimation printed images and a method of making such a fabric book. The fabric book of the invention has a plurality of fabric pages. The fabric pages are made of a synthetic material with an original softness corresponding to the synthetic material. At least one fabric page has a high resolution sublimation printed image imprinted using the method of the invention. The fabric page with the high resolution image substantially retains the original softness, even after printing.

The preferred method of creating the high resolution images in the fabric books begins with selecting an appropriate original object. A digital rendition of the original object is created. The digital rendition is edited to create an edited image with optimum print resolution. A color separation is performed on the edited image to create a color separated image. Optimal sublimation inks are prepared and suitable sublimation paper is selected. Using the optimal sublimation inks, the color separated image is printed onto film or directly onto a plate. The image is then offset printed onto the suitable sublimation paper. The image is sublimated from the sublimation paper to a fabric sheet creating a fabric sheet with a high resolution image. To create the high resolution on the fabric sheet, the imprinted portion of the fabric sheet may be polyester, nylon, and polyester/cotton blend fabrics (no more than 5% cotton), and the like, but not cotton or other naturally occurring fabrics. The fabric sheet with the high resolution image may then be combined with other fabric sheets (with or without high resolution images) to form a fabric book.

17 Claims, 3 Drawing Sheets

U.S. PATENT DOCUMENTS

| | | | | |
|---|---|---|---|---|
| 6,290,798 | B1 | 9/2001 | Onishi et al. | 156/230 |
| 6,308,630 | B1 | 10/2001 | Kurokawa et al. | 101/492 |
| 6,486,904 | B1 | 11/2002 | Onozato et al. | 347/213 |
| 6,582,803 | B2 | 6/2003 | Cole et al. | 428/195 |
| 6,608,641 | B1 | 8/2003 | Alexandrovich et al. | 347/131 |
| 6,815,397 | B2 * | 11/2004 | Ishida et al. | 503/227 |
| 2002/0008748 | A1 | 1/2002 | Suga et al. | 347/103 |
| 2002/0098312 | A1 | 7/2002 | Sloot | 428/45 |
| 2002/0149658 | A1 | 10/2002 | Furukawa | 347/101 |
| 2002/0167582 | A1 | 11/2002 | Onozato et al. | 347/219 |
| 2003/0087174 | A1 | 5/2003 | Wagner et al. | 430/124 |
| 2003/0182210 | A1 | 9/2003 | Weitzman et al. | 705/27 |

* cited by examiner

SOFT FABRIC BOOK WITH HIGH RESOLUTION IMAGES AND METHOD OF MAKING SAME

RELATED APPLICATION

This application claims the benefit of U.S. Provisional Application Ser. No. 60/583,092, filed Jun. 25, 2004.

FIELD OF INVENTION

The present invention relates to fabric imprinted with images, and to fabric books imprinted with high resolution images.

BACKGROUND OF INVENTION

It is well known that in the first few months of life a baby will respond to high contrast images (which are images where there is significant tonal gradation between the highlights, midtones, and shadows) and then, as the baby matures, to full front views of actual faces of people and anthropomorphic animals. As the baby matures from an infant to a toddler, the baby will rapidly learn to recognize familiar views of humans, animals, and everyday objects. The developmental response to realistic images, particularly photographic images, has been shown to be linked in the first few weeks and months of life to the maturation of the eye and brain, and then, thereafter, to the baby's general overall cognitive skills. Images also stimulate infants' and toddlers' emotional responses and hand-eye coordination. Images used for such visual stimulation include graphics, but as the babies age beyond three months they can recognize lower contrast images and higher definition photographs. Thus, these types of images are preferred for older babies.

Such images many times are presented in a book format. The book format offers convenience (i.e., numerous images compiled together in a flat and easy to see format), and potential educational benefits (i.e., an introduction to books, which may foster a desire to read in the future).

Children's books come in board (paper), soft plastic, wood, or fabric. Board books generally offer higher resolution graphics than the other types of books but, many times, the graphics are presented in a way that does not effectively stimulate a response from babies. For example, many photographs are too complex, taken from unfamiliar angles, do not have sufficiently high contrasts, or do not have sufficiently high resolution. Even when the board books contain photographs that are effectively stimulating, board books are not ideal for infants and toddlers because they have sharp corners, are not easily disinfected, and are generally heavy. In addition, babies have a tendency to grab and chew anything they can get their hands on, or their mouths to. This includes books. When a baby chews a board book, the edges of the board will start to disintegrate, and once the board breaks down, it will become a choking hazard.

Wood books comprise thin wooden pages with printed images. Wood books typically have holes in them such that the individual pages may be bound with string or plastic. Wood books are heavy and can be dangerous. Image quality on wood books is limited to silk-screen printing techniques or heat transfers where the transferred images do not sublimate into the wood. Because the ink does not sublimate into the wood, it can be scratched off, creating potential a choking hazard.

Plastic books comprise sheets of thin polyvinyl or similar plastic, and are typically used as "bath books." The sheets may be printed and heat sealed around a foam filling. Plastic books, as with board books, tear and degrade into small parts. The plastic material is not soft. The image resolution on the plastic sheets is limited to silk screen mass production resolutions in the order of 120 dots per inch (dpi), although they can run higher (e.g., 300 dpi) at slower mass production speeds. However, there is significant dot gain, which reduces image contrast. Images can be applied through heat transfer, but not sublimation. To ensure that transferred images are not scratched off, the images are typically printed on the inside of the plastic. The result is that the plastic "clouds" the contrast of the image.

In contrast to the above-mentioned books, typical fabric books are lightweight, soft, disinfect easily by washing, and substantially maintain their integrity after repeated handling. As a result, fabric books are ideal for babies. However, attempts to provide high resolution graphics in fabric books using current technology encounter significant drawbacks. The main drawback is that current printing technology used for printing on fabrics, i.e., photo transfer, silk screening, and offset printing, causes the ink material to lie on top of the fabric and/or stiffen the printed fabric surface. A fabric book made by one of those processes may contain high resolution printed images, but the resulting book loses the benefit of having the soft fabric, is more difficult to wash, and presents an additional hazard to a baby from the flaking of the ink over time.

Another current printing technology for fabric books, sublimation printing, overcomes these drawbacks and keeps the fabric soft but has other drawbacks, including significant alteration of the color balance of the original art, and significant degradation of the resolution and color balance of the printed image due to the woven texture and light reflectance of printed fabrics. The fabric of a fabric book made by this process substantially maintains its original softness after printing, but the printed images are not high resolution images.

Therefore, there is a need for a fabric book with high resolution printed images that substantially maintains its original softness after printing. There is also a need for a method of printing high resolution images in fabric (particularly fabric used in fabric books) that allows the printed fabric to substantially retain its pre-printed softness and be safely handled and manipulated.

SUMMARY OF THE INVENTION

The invention encompasses a fabric book and a method of making the fabric book, wherein the fabric book comprises high resolution printed images and the printed fabric substantially maintains its original softness after printing.

The fabric book of the invention comprises a plurality of fabric pages that comprise a synthetic material with an original softness. At least one fabric page is imprinted with a high resolution image created using the method of the invention. The softness of the fabric page with the high resolution image (after printing) is substantially the same as the original softness (before printing).

The preferred method of creating the high resolution images in the fabric books begins with selecting an appropriate original object. A digital rendition of the original object is created. The digital rendition is edited for optimum print resolution to create an edited image. Color separation is performed on the edited image to create a color separated image. Optimal sublimation inks are prepared and suitable sublimation paper is selected. Using the optimal sublimation inks, the color separated image is printed onto film or directly onto a plate. The image is then offset printed onto sublimation paper. The image is sublimated from the sublimation paper into a fabric sheet, creating a fabric sheet with a high resolution image. To create the high resolution on the fabric sheet, the imprinted area of the fabric sheet may be polyester, nylon, and polyester/cotton blend fabrics (with no more than 5% cotton), and the like, but not cotton or other naturally occurring fabrics. The fabric sheet with the high resolution image may then be combined with other fabric sheets (with or without high resolution images) to form the fabric book.

In order to minimize loss of detail in the sublimation printed fabric, minimize distortions of original color balance, and minimize other drawbacks of offset printing and the sublimation process that will affect the resolution and color balance of the sublimation printed image, all or most of the following will need to be performed: selecting original subjects with high definition of elements, strong color contrasts, and strong lighting; creating a digital rendition of the subject of at least 300 pixels resolution; creating and profiling a separated image in the order of, and/or equivalent to 150 lpi or higher; selecting sublimation paper with optimal weight, stock and having the optimal surface treatment for offset sublimation printing (e.g., smooth, 70 lb, white, coated paper, with neutral pH); preparing sublimation inks that provide optimal brightness of colors, color intensity, and the least amount of color bleed and dot gain, and that have the content of alcohol and alcohol replacements as low as possible to minimize emulsifying of the inks; and sublimating a test print at a controlled temperature and pressure and for a fairly precise time period, into the fabric, evaluating the effect of the dot gain and color bleed, adjusting the color balance of the digital or separated image, reprinting the reverse image on the sublimation paper using the adjusted color balance, and sublimating the image into the same or similar fabric used in preparing the test prints.

BRIEF DESCRIPTION OF THE DRAWINGS

For the purpose of illustrating the invention there is shown in the drawings various forms which are presently preferred; it being understood, however, that this invention is not limited to the precise arrangements and instrumentalities particularly shown.

DETAILED DESCRIPTION OF THE INVENTION

Figure 1A:
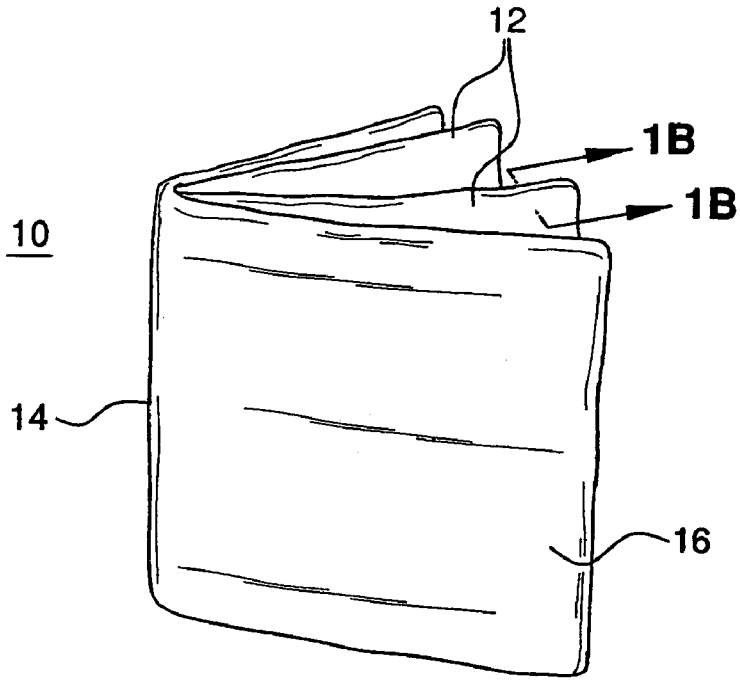
FIG. 1A shows a perspective view of an embodiment of a fabric book of the invention.

With reference to the drawings, where like numerals identify like elements, there is shown in FIG. 1A a fabric book 10 in accordance with an embodiment of the present invention.

Book 10 comprises a plurality of fabric pages 12, a spine 14, and a cover 16. Fabric pages 12, spine 14, and cover 16 preferably comprise a synthetic material. Fabric pages 12, spine 14, and cover 16 may comprise a combination of synthetic material and natural material, but where high resolution images are to be printed, cotton and other naturally occurring fabrics generally are not suitable. Although it is understood that a synthetic material is preferred for the spine 14 and cover 16 of the fabric book 10, the following discussion focuses on the fabric pages 12.

Fabric pages 12 preferably comprise one or more of polyester, nylon, or polyester/cotton blend fabrics with at least 95% polyester, but other synthetic materials may be used. Additionally, white colored fabrics are preferred because they give the truest color reproduction.

Fabric pages 12 may also comprise light reflective fabric. Light reflective fabric is fabric that incorporates thousands of tiny glass beads that reflect light, incorporates reflective yam woven into a non-reflective fabric, or incorporates some other known technology that absorbs light in the invisible, or near ultra-violet, region of the light spectrum and then re-emits this light as fluorescence in the visible region of the spectrum. The re-emitted light preferably occurs between 420-500 nm. The reflectivity of the fabric provides for fabric pages that are brighter than standard synthetic fabric pages. In addition, the use of the light reflective material provides for a stronger, more durable fabric. To achieve high resolution images of the invention, high light reflectance is preferred.

The fabric pages 12 have an original softness characteristic of the synthetic material used in creating the fabric pages. The softness of the material refers to the combination of the material's conformability and the tactile feel of the material's surface. The original softness of the fabric pages 12 will depend on the synthetic material used.

Figure 2:
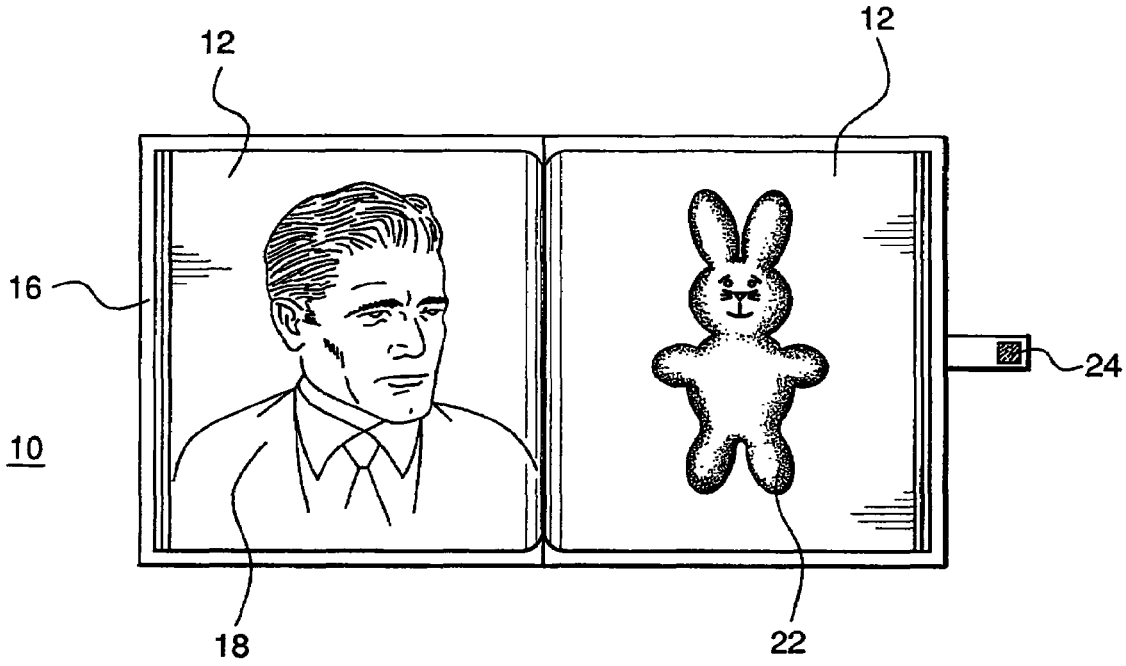
FIG. 2 shows a plan view of an embodiment of a fabric book of the invention with a high resolution photographic image on one page and a removable fabric piece on an opposing page.

At least one fabric page 12 of the fabric book 10 comprises a high resolution image 18 as shown in schematic form in FIG. 2.

The sublimation printing of the high resolution image in the fabric page should not materially affect the softness of the fabric page. In fact, the softness of the fabric page with the high resolution image should be substantially the same as the original softness, which, as noted above, is the softness prior to printing. In other words, the sublimation printing of the high resolution image in the fabric page should not significantly stiffen the fabric page material and should not create a noticeable layer of ink on top of the fabric page material.

Figure 1B:
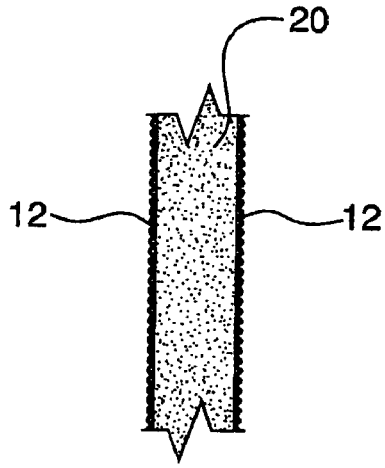
FIG. 1B shows a cross section view through a page of the fabric book shown in FIG. 1A.

As shown in FIG. 1B, fabric pages 12 of fabric book 10 may also comprise a filler 20 constructed inside fabric pages 12. Page fillers 20 are constructed to keep the printed images flat and easy to see. The preferred filler is ¼-inch thick, die cut polyester foam. Die cut polyester foam provides adequate stiffness to allow an image on the page to lay flat, but at the same time provides adequate pliability to allow the book to be manipulated by a baby, or by an adult reading to a baby. To achieve high resolution images of the invention, the fillers preferably have a light reflectance substantially corresponding to the fabric page.

In addition to the high resolution images, the fabric book may comprise many other features. As shown in FIG. 2, the fabric book may comprise a high resolution image 18 printed in one fabric page 12 and a removable play piece 22 (shown as a fabric bunny) on an opposing fabric page 12. Removable piece 22 may be made of fabric, plastic, or other material safe for babies. Removable piece 22 may be held in place with a hook and loop fastener, may be set in a recess in the book, or may be held in the book by some other means that allows safe and efficient removal and replacement of the piece.

The fabric book may also have non-removable elements sewn into the fabric book. The elements may include one or more of a fabric element, a plastic element, or a mirror.

Any items sewn into the fabric, including, but not limited to, the fabric pages and the non-removable elements, are preferably machine sewn with 1/32-inch double sewn stitches. Hand stitching should not be used because of the tendency of hand sewn seams to provide a point of weakness during mass production. Any sewn seams preferably have a 100% pass rate on pull tests.

Also as shown in FIG. 2, the fabric book may comprise a hook and loop fastener 24 for securing the fabric book in a closed position. Alternatively, the book may comprise a snap closure that allows the book to be secured in a closed position. The snap closure preferably comprises a plastic material, but other materials that are safe for babies may also be used. The fabric book may comprise other alternative closures, provided that the closures are safe for babies.

Figure 3:
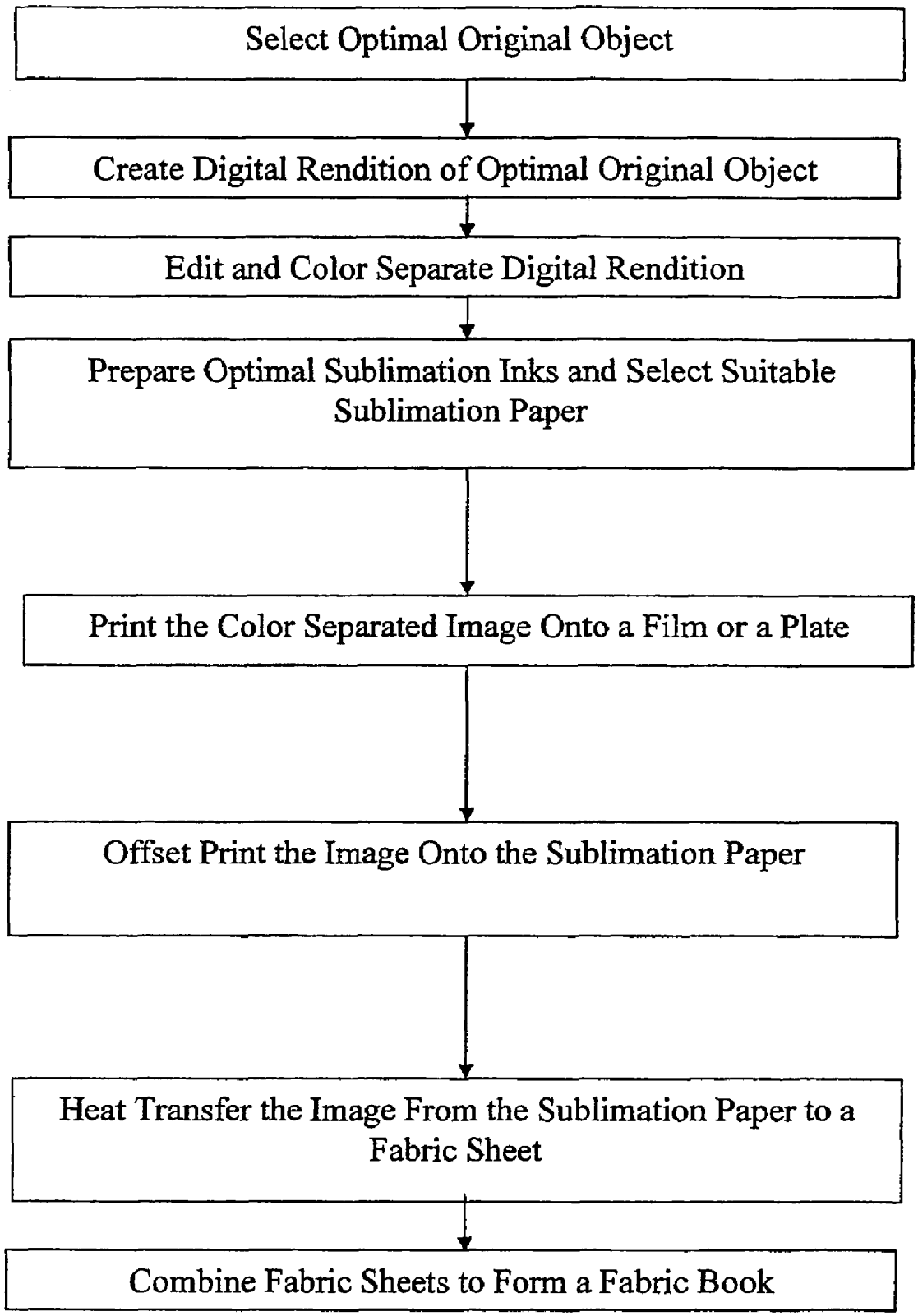
FIG. 3 is a flow chart of the key steps of an embodiment of the method of creating high resolution images in the fabric books.

The preferred method of making the high resolution, offset printed fabric book is outlined in FIG. 3. The preferred method begins with selecting an appropriate original object. A digital rendition of the original object is created. The digital rendition is edited for optimum print resolution to create an edited image. A color separation is performed on the edited image to create a color separated image. As the preferred method continues, optimal sublimation inks are prepared and suitable sublimation paper is selected. Using the sublimation inks, a color separated image is printed onto film or directly onto a plate. The image is then offset printed onto the suitable sublimation paper. The image is sublimated from the suitable sublimation paper into a fabric sheet, creating a fabric sheet with a high resolution image. The fabric sheet may then be combined with other fabric sheets to form the fabric book.

A critical component to obtaining a high resolution image in a fabric is the selection of an "appropriate original object." The appropriate original object can be a real object (e.g., an animal, a person, or a tree) or a photograph or illustration. The discussion below of the appropriate original object focuses on the original object as a photographic image or illustration, but many, if not all, of the characteristics set forth below also relate to an original image that is a real object.

The appropriate original image should have an optimal color balance (accented primary and secondary colors), a high percentage of primary and secondary colors, a high definition of elements, strong color contrasts, a high contrast of main image (foreground) from background, and diffuse and even lighting. Images with strong color contrasts have strong differences between different colors within the photograph. Images with diffuse and even lighting have lighting that is low or moderate in contrast throughout the entire photograph, such as a photograph taken on an overcast day. The lighting should accentuate details and retain a white light color balance.

To achieve high resolution images of the invention, the original image preferably comprises views familiar to the target audience of the image, and images that are developmentally appropriate for the target audience. Original images for babies three months of age or younger need to be almost black and white or, at a minimum, have a very strong color. contrast such as red on white, or purple on white. For example, (i) a forward looking face with wide eyes that have very dark irises and white eyeballs, with a middle tone face that has strongly defined lips (e.g., with red lipstick), and with black or dark hair; or (ii) a yellow duck bath toy on a dark blue background.

As the target audience of the image changes (for example, from newborn to approximately three months of age, or babies approximately three months to approximately nine months of age), contrast in the appropriate original image remains important, but not to the same degree as for the first three months. For the older months, appropriate original images preferably have high tonal contrast, familiar views of objects, distinctive color combinations (e.g., in clothes). Lighting for appropriate original images needs to preserve or even accentuate the contrast of distinctive features. The accentuation of contrast may be accomplished with filters that reduce glare or by using images that have lighting that does not accentuate a specific part of the color spectrum.

It is contemplated that images for fabric books targeted for infants three to nine months of age will comprise full front photographs of human or animal heads. Preferred photographs will have key facial features well defined by color and light contrast and not covered or concealed. Highlights, if used at all, should only be in the iris of the eyes. Lighting should be diffuse, with some accentuation to increase the color or tonal contrast for facial features. Heads should be selected on the basis of the color contrast of its features such as hair, iris and whites of eyes, eyebrows, and lips. Mouths can smile, or look sad, but should not be open.

It is contemplated that images for fabric books targeted for infants nine to eighteen months of age may, in addition to full front photographs of human and animal heads, further comprise high contrast familiar views of familiar objects, such as people, animals, cars, houses, and other familiar things. Familiar views are views taken from the perspective of an infant nine to eighteen months of age, and include, but are not limited to, full front views and profile views.

If the appropriate original object is a photographic image or illustration, the image should be a resolution such as is shown in a high quality magazine or a high quality book (e.g., an art book). The greater the resolution of the original image, the greater resolution potential for the image in the fabric.

The appropriate original image should also have few highlights and few dark elements. Highlights should be avoided because they will sublimation print as white and thus need to be used with care. A white area instead of a highlighted area will reduce the overall resolution of the image in the fabric and also alter the image in the fabric from how the original image appeared. Dark elements in the original image should be avoided because they may sublimation print as black. A black element in place of a dark element will provide a distorted depiction of the original image.

From a child development point of view, the reason for ensuring proper selection of an appropriate original object is linked to a child's experience with objects, the things that define an object, and, in the first three months, literally their ability to see and interpret visual stimulation. For these reasons, it is critical that the selection of the appropriate original object be made carefully.

Once the appropriate original object is selected, the second step of the method comprises editing an image of the appropriate original object to create an edited image and subsequently performing a color separation on the edited image.

The editing portion is preferably accomplished by first creating a digital rendition of the appropriate original object so that the digital rendition can be edited using commercial editing software known in the art. If the appropriate original object is a real object, the digital rendition can be created by taking a digital photograph of the real object. If the appropriate original object is a photographic image or an illustration, the digital rendition can be created by making a digital scan of the photographic image or illustration. The digital rendition should have a digital resolution of at least 300 pixels per inch ("ppi").

The digital rendition should be edited to achieve "optimum print resolution." For purposes of obtaining a high resolution image, optimum print resolution is achieved by accentuating primary and secondary colors (e.g., removing black dots from a purple or blue area), by removing highlights and dark areas, and by adjusting the four basic ink colors: cyan, magenta, yellow, and black (commonly referred to as "CMYK") so as to avoid over about 300% ink coverage (i.e., it is preferred to have less than about 100% of each of the three process colors other than black). Primary and secondary colors use the least amount of process colors thereby limiting the color separation, maintaining the high reflectance of the fabric, and making dot gain more predictable. Visually, primary and secondary colors are more easily distinguished from one another, which allows for greater perception of details and greater separation of objects from the background.

Ideally, the edits to achieve optimum print resolution result in accurately compensating for dot gain, ensuring purity of color, ensuring high color contrasts that distinguish foreground images from the background, and ensuring that key features of the image are distinguishable. To achieve high resolution images of the invention, the dot gain needs to be controlled and accurately compensated for. For the purpose of editing the image, the dots in each of the four process color layers (i.e., CMYK) are assumed to follow predictable dot gain curves.

After editing, color separation is performed on the edited image to create a color separated image. Color separation is the act of separating a color graphic or photograph into single-color layers. The edited image is separated into the four basic ink colors (i.e., CMYK), after which each single-color layer can be printed separately, one on top of the other, to give the impression of infinite colors.

When the edited image is a digital image composed of pixels, color separation entails converting the pixilated image to CMYK dot values. The CMYK dot values can be made visible on a negative film (one per process color in dot form) or on an offset printing plate, and/or printed on a proof press or another printing machine.

During the color separation of this invention, the color black is preferably masked out of all color areas. In fact, black should be used only to outline elements or when an element needs to be black (for example, the pupils of a person's eyes). The result of the proper color separation starts with an original digital image with high color contrast and detail at a resolution in the order of 300 pixels and higher, and ends in an accurately profiled color separated image of at least 150 lpi (lines per inch) or 150 lpi equivalent. For high resolution sublimation printing FM screening (also called frequency modulation or stochastic printing) is preferred over AM screening (also known as conventional or half tone screening). The FM screens provide a dot size that is smaller (where a 150 line (equivalent) has a dot size of about 26 microns, but dots can range from about 14 to about 21 microns), a dot density that is higher, and a dot gain, though higher than AM, that is more predictable and can be better compensated for. Other advantages include the elimination of moire patterns, heavier ink coverage, faster press make ready, shorter drying times, the elimination of registration problems, reduced over printing, the elimination of mid tone jump, and less white space (which allows a more accurate reproduction of color). However, with FM screens press control has to be significantly tighter, dots need to be sharper, and plates have to be fully exposed.

It is contemplated that editing of the digital rendition, to compensate for dot gain, will be more predictable if the digital rendition has a high percentage of primary and secondary colors, high color contrasts, and few highlights and dark areas. In such a situation, color separation can be performed on the digital rendition with significantly less editing.

To achieve high resolution images of the invention, a CMYK match with variance of less than 5% is preferred. A CMYK match is a color match between reflective art or what is seen on-screen (i.e., pixels in the digital image), and the color balance of the image in the actual sublimation printed fabric. The match is a measure of the radiation levels and color spectrums of the reflective art, or pixels (on-screen), and the reflectance and fluorescence values of the sublimation printed fabric). Matches greater than 5% are contemplated in some circumstances. For example, where the original image contains fluorescent colors, the fluorescence values of the sublimation dyes cannot be exactly matched. Thus, in such a circumstance, greater variation is contemplated.

Accurate compensation for dot gain and the maintenance of color balance is particularly important for achieving the high resolution of this invention as there is no accurate means to color proof. The color of the dies, when offset printed onto sublimation paper, are not as bright as they will appear after sublimation onto fabric. A further complication is that when FM screens are used adjusting color on press is not feasible as dot gain is not easy to change by adjusting ink film densities. However, an ink jet printer can be profiled to produce sublimation prints on fabric that closely resemble the sublimation printed fabric using offset printed sublimation paper. A further press control can be that of sampling offset printed sublimation sheets during production and sublimating them onto samples of the fabric using a small flat bed heat press.

The third step in the method is the proper preparation of "optimal sublimation inks" and proper selection of "suitable sublimation paper." Optimal sublimation inks, such as Pyroscript inks supplied by the Gans Ink Company, offer brilliant color and good resistance to the effects of light and laundering. The optimal inks must be capable of withstanding repeated machine washing with standard laundry detergent and repeated exposure to fluorescent, halogen, and sun light, while still maintaining their integrity and color fastness. Excessive washing and/or excessive exposure to light sources may eventually cause even the optimal inks to fade, but the optimal inks should be able to withstand normal wear and tear.

The optimal inks must also provide substantial color brightness, substantial color intensity, and minimal color bleed and dot gain. Color brightness is the difference in the intensity of light reflected from or transmitted through an image independent of its hue (the main attribute of a color that distinguishes it from other colors) and saturation (the amount of gray in a color). Color intensity is the brightness or dullness of a color.

Color bleed occurs when a color extends beyond the area from which it was originally associated in the original image. Color bleed in the sublimated printed fabric occurs when the ink from the printed dot on the sublimation paper diffuses into an area larger than that from which it was originally associated. Both high color bleed and not accurately compensated dot gain reduce the resolution of the image in the fabric, and therefore are to be avoided by, for example, selection of an optimal sublimation ink that minimizes color bleed.

Optimal sublimation inks are available in a wide variety of colors including, 4/Color Process, fluorescents (which helps accentuate the light reflection of the sublimation printed surface), Pantone shades, and dense Black. However, an exact match is not possible for some colors. For example, sublimation inks are not currently available in opaque or metallic colors.

The optimal sublimation inks should have a low content of alcohol and alcohol replacement solvents so as to minimize emulsifying of the inks. As used herein "low content" refers to a percentage by weight of less than 5%. In addition, sublimation inks tend to be very fluid and spread easily on and into a printed substrate, so inks with a slightly higher tack than normal are preferred. A higher tack ink can be obtained by, for example, the addition of Benzenite clay or aerosol powder. The optimal sublimation inks may be run with either conventional or integrated dampening systems.

To achieve high resolution images of the invention, it is preferred that the optimal sublimation inks be used in conjunction with the suitable sublimation paper. The preferred embodiment of the suitable sublimation paper comprises a smooth, white, coated paper, with a substantially neutral pH. The weight of the suitable sublimation paper is preferably 60 to 70 pounds.

In combination with the sublimation ink and sublimation paper, conventional printing blankets may be used. Conventional printing blankets are preferred over the longer life compressible blankets normally used for sublimation printing, in that conventional printing blankets have a greater capability of reducing dot gain.

The fourth step of the method is the "optimal processing" of the image. Optimal processing of the image preferably entails translating the pixalated image into a color separated film, or directly onto a plate, to create a translated image. The preferred embodiment of this step is to print a reverse image onto a film. However, if the image is directly printed onto a plate, the image is not reflected, i.e., a forward, and not a reverse, image is printed on the plate.

The translated image is then offset sublimation printed onto the suitable sublimation paper. The offset printing is preferably accomplished using lithographic equipment to print the image with optional sublimation inks.

The next step of the preferred method is the "optimal sublimation printing" of the image onto a fabric. This step preferably entails sublimating the translated image from the suitable sublimation paper into the fabric.

Selection of an appropriate fabric to receive the image is important. The fabric preferably comprises one or more of polyester, nylon, or polyester/cotton blend fabrics with no more than 5% cotton. To achieve high resolution images of the invention, the fabric preferably has a thread count of at least 250, and more preferably 250 to 400. The portion of the fabric receiving the ink must be a synthetic fabric. Cotton and naturally occurring fabrics are not suitable for this process. Additionally, due to the transparent nature of sublimation dyes, white colored fabrics are preferred because they give the truest color reproduction. Because variability in fabric type can lead to vastly different results in printing, pre-testing is recommended to determine suitability of a particular product.

The discussion below of the optimal sublimation printing is premised on the use of a reverse image on a film. To transfer the reverse image into the selected fabric, the suitable sublimation paper is laid on top of the fabric, with the image side down. The dyes in the ink are then exposed to heat using heated rollers, a flat bed heat press, or other accepted means. The exposure to heat causes the dyes in the ink to sublimate, i.e., convert directly from a solid state to a vapor state, without passing through a liquid state. The vaporized colors permeate the fibers of the fabric before returning to solid form. Because the color infuses the fabric, it is less vulnerable to fading and distortion over time.

The temperature necessary to sublime the inks is dependent on the inks, the fabric, and the amount of time heat is applied (i.e., dwell time). For example, some commercially available offset sublimation inks require a constant temperature of from about 390 to about 410 degrees F. for about 25 to about 35 seconds at from about 60 to about 80 psi on 100% polyester fabrics. Other materials and other inks may require variations in one or both of the temperature and the dwell time.

The end result of the method generally, and the optimal sublimation printing specifically, is a synthetic fabric comprising a high resolution image.

Although there is a standard dot gain when printing the sublimation paper, which is higher for FM, than AM, but more predictable and easier to compensate for in FM, color bleed caused by the sublimation process may be significant and is dependent on all of the variables, including but not limited to, the original image selected, the sublimation inks used, the sublimation paper used, and the fabric used. Selecting the appropriate original object, accurately compensating for dot gain, using the optimal sublimation inks, using suitable sublimation paper, and, for example, closely woven polyester minimizes color bleed. However, it is contemplated that additional steps may be necessary to sufficiently reduce color bleed so as to achieve a higher resolution image in the fabric, with substantially accurate balance and a high level of detail.

The additional steps entail sublimating a test print into the fabric, evaluating the effect of the dot gain, adjusting the color balance, reprinting the reverse image on the sublimation paper using the adjusted color balance, and reprinting the image into the fabric.

As noted above, during color separation, dots in each of the four process color layers (i.e., CMYK) are assumed to gain according to a fairly predictable dot gain curve. After sublimation printing, the color bleed, color balance and level of detail is evaluated for the effect of the dot gain compensation, in other words, evaluated to see if the assumption of proportional dot gain was correct. For example, an original separation may have a sky color equivalent to 50% cyan and 10% magenta. However, after sublimation, the color balance may be equivalent to 55% or 60% cyan and 20% magenta because of disproportionate dot gain. The separations must be adjusted to substantially compensate for this disproportionate dot gain. That is the purpose of the test sublimation prints. Once test images have been sublimation printed into a test piece of the selected fabric, dot gain and color bleed, color balance, and the level of detail, for the various percentages can be measured and averages determined. From the averages, separations may then be adjusted to substantially compensate for disproportionate gains.

Once the separations are adjusted, a reverse image of the edited image is again printed onto suitable sublimation paper using the optimal sublimation inks. The reverse image is then sublimated from the optimal sublimation paper to the fabric in the manner discussed above. If disproportionate color bleed, loss of color balance, or loss of detail are again found in the image printed in the fabric, the additional optional steps are repeated until disproportionate color bleed, loss of color balance, or loss of detail are substantially eliminated and/or compensated for.

The test prints serve another purpose as well. When first printed onto sublimation paper, sublimation inks appear to be weaker and duller than standard Lithographic inks. However, when sublimated into fabric, selected dyes develop their true color, strength and brilliance. Therefore, a test print into the fabric of choice serves to provide a true picture of the finished product, which cannot been seen from the reverse image on the sublimation paper, prior to running the entire job.

Different fabric types receive inks in different ways. Therefore, it is important that the test image be printed in the same or substantially the same fabric as that which will ultimately receive the finished image.

After printing, the softness of the fabric with the high resolution images printed thereon should be substantially equivalent to the original softness of the fabric. In other words, the printing should not stiffen or substantially rest on top of the fabric surface, which is typical in standard silk-screen printing and in offset printing directly onto fabrics.

The printing of the high resolution images can be repeated for multiple sheets of fabric. These fabric pieces may be combined together and/or with fabric sheets without high resolution images to form a fabric book. The fabric book, ideally, presents high-resolution images to a baby in a manner that is safe for the baby to handle, is soft to touch, and that can be easily manipulated.

The fabric books also may combine silkscreen printing and sublimation printing. For example, some of the pages of the fabric book may have high resolution images printed by an embodiment of the method described above, while other pages have images and text printed using silkscreen printing. In fact, any combination of silkscreen printing and printing with an embodiment of the present method may be used, including but not limited to, silkscreen printing on the cover and printing with the present method on the pages, printing with the present method on the cover and the pages and silkscreen printing on other pages, and silkscreen printing and printing with the present method on the same page or cover.

The fabric book may have devices capable of providing a sound effect either electronically or mechanically, flaps with high resolution photographic images, teething elements, manipulable elements such as rings or finger puppets, and so on.

The fabric book may be formatted in a traditional book shape (e.g., square or rectangle) or it may be formatted in a non-traditional book shape (e.g., triangle, oval, circle, octagon and so on). The non-traditional book shapes may correspond to the photographic images in the fabric. For example, if the photographic image transferred into the fabric comprises the picture of dog's head, the book may be shaped as a dog's head. The fabric book may also be constructed with fabric handles for carrying the book.

Various components of the fabric book are preferably bound with 1/32-inch double machine sewn stitches. Hand stitching should not be used because of the tendency of hand sewn seams to provide a point of weakness during mass production. The stitching should have a 100% pass rate for pull tests on all seams and all locations were stitching is present. Further, the fabric books should be constructed such that, when complete, the fabric books pass International Toy Safety Standards and Regulations. These safety standards include, but are not limited to, EN 71 (Safety of Toys), DIN 53160 (Color Fastness to Saliva and Perspiration), and various ASTM, AUNZ, and CHP standards concerning flammability, small parts, toxicity, heavy metals, Formaldehyde, Azodye, Phalates, vinyls, and mechanical hazards. After manufacturing, the fabric books should be packaged in an airtight packaging to ensure the fabric book is hygienic and meets international hygiene standards.

Although the discussion of the invention focuses on the application of the methods to a soft fabric book, the invention is not so limited. The methods of this invention may also be used on formats that are similar to soft fabric books such as some baby toys, and a fold out frieze. A fold out frieze differs from a fabric book in that a fold out frieze functions more as an "accordion" fold rather than being sewn to function as a book with individual folding pages. The printed fabric of a fold out frieze is a long rectangle, say 12"×4", with double sewn lines every 4" such that the long rectangle easily folds along the sewn lines but also folds out into a "poster like" frieze. The key component in formats other than fabric books is the ability of the other formats to provide the high resolution photographic images in a relatively flat manner.

It will be appreciated by those skilled in the art that the present invention may be practiced in various alternate forms and configurations. The previously detailed description of the disclosed methods is presented for clarity of understanding only, and no unnecessary limitations should be implied therefrom.

I claim:

1. A method of making a fabric book with high resolution images, the method comprising:

selecting an appropriate original object;

creating a digital rendition of the appropriate original object;

editing the digital rendition to achieve optimum print resolution in an edited image;

performing color separation of the edited image to create a color separated image;

preparing optimal sublimation inks and selecting suitable sublimation paper;

translating the color separated image into a film or a printing plate to create a translated image;

using the optimal sublimation inks to offset print the translated image from the film or the plate to create an image on the suitable sublimation paper;

sublimating the image from the suitable sublimation paper to a synthetic fabric sheet using a heat transfer process to form a synthetic fabric sheet with a high resolution image; and combining the synthetic fabric sheet with other fabric sheets to form the fabric book.

2. The method of claim 1 wherein the appropriate original object comprises one or more of a high percentage of primary and secondary colors, a high definition of elements, strong color contrasts, a high contrast of a main image from a background, and diffuse and even lighting.

3. The method of claim 1 wherein the digital rendition has a digital resolution of at least 300 pixels per inch, the separated image has a resolution equivalent to at least about 150 lines per inch, and the sublimated image has a resolution equivalent to at least about 150 lines per inch or higher.

4. The method of claim 1 wherein the optimal sublimation inks comprise Benzenite clay or aerosol powder, wherein the Benzenite clay or aerosol powder increase the tack of the optimal sublimation inks.

5. The method of claim 1 wherein the optimal sublimation inks comprise low amounts of alcohol and alcohol replacement solvents.

6. The method of claim 1 wherein the suitable sublimation paper comprises a smooth, white coated paper with a neutral pH.

7. The method of claim 1 wherein the synthetic fabric sheet comprises one of polyester, nylon, or polyester/cotton blend fabrics with no more than 5% cotton.

8. The method of claim 7 wherein the synthetic fabric sheet comprises polyester.

9. The method of claim 8 wherein the synthetic fabric sheet comprises close woven polyester.

10. The method of claim 1 wherein the synthetic fabric sheet has a thread count of at least about 250.

11. The method of claim 10 wherein the thread count is from about 250 to about 400.

12. The method of claim 1 wherein the combining of the fabric sheets comprises binding with 1/32-inch double machine sewn stitches.

13. The method of claim 1 wherein the sublimating step is performed using Frequency Modulated screens.

14. A method of creating a soft synthetic fabric sheet with high resolution images to stimulate infants or toddlers, wherein the method comprises the steps of:

selecting an appropriate original image, the image comprising a high percentage of primary and secondary colors;

performing a color separation of a digital rendition of the appropriate original image to create a color separated image;

preparing sublimation inks with low amounts of alcohol and alcohol replacement solvents, the sublimation inks offering brilliant color and good resistance to the effects of light and laundering;

selecting smooth, coated paper with a substantially neutral pH to act as sublimation paper;

using the sublimation inks to offset sublimation print a reverse image of the color separated image onto the sublimation paper;

selecting a synthetic fabric sheet with an original softness and a thread count of at least 250; and transferring the reverse image from the sublimation paper to the synthetic fabric sheet using a heat transfer process to create a high resolution image in the synthetic fabric;

wherein the synthetic fabric sheet substantially maintains the original softness after printing.

15. The method of claim 14 wherein the synthetic fabric sheet with the high resolution image is bound with one or more other fabric sheets to form a fabric book.

16. A method of creating a soft synthetic fabric sheet with high resolution images to stimulate infants or toddlers, wherein the method comprises the steps of:

selecting an appropriate original image, the image comprising high definition of elements, strong color contrasts, and diffused and even lighting;

performing a color separation of a digital rendition of the appropriate original image to create a color separated image;

preparing optimal sublimation inks and selecting suitable sublimation paper;

offset printing a reverse image of the color separated image onto the sublimation paper using the sublimation inks;

sublimating the reverse image from the sublimation paper to a test piece of the synthetic fabric sheet using a heat transfer process;

comparing the image on the test piece of the synthetic fabric with the original image to measure color balance;

adjusting the separated image to compensate for disproportionate dot gain, color bleed, loss of color balance, and/or loss of detail;

repeating the steps of printing a reverse image, sublimating the image, and adjusting the separated image until the disproportionate dot gain, color bleed, loss of color balance, and/or loss of detail is substantially eliminated; and sublimating the image with the adjusted color balance into the synthetic fabric sheet with an original softness corresponding to the synthetic material using a heat transfer process, wherein the synthetic fabric sheets remain substantially soft after printing.

17. The method of claim 16 wherein a plurality of the synthetic fabric sheets with high resolution images are bound together to form a fabric book.

* * * * *